US006043473A

United States Patent [19]

Isogai et al.

[11] Patent Number: 6,043,473

[45] Date of Patent: Mar. 28, 2000

[54] SELF LUBRICATING DOOR KEY AND DOOR HOOK FOR HIGH FREQUENCY HEATING APPARATUS

[75] Inventors: Mamoru Isogai, Nara; Toshio Kai, Kyoto, both of Japan

[73] Assignee: Matsushita Electric Industrial Co., Ltd., Japan

[21] Appl. No.: 09/000,018

[22] PCT Filed: Jul. 19, 1996

[86] PCT No.: PCT/JP96/02035

§ 371 Date: Apr. 6, 1998

§ 102(e) Date: Apr. 6, 1998

[87] PCT Pub. No.: WO97/05428

PCT Pub. Date: Feb. 13, 1997

[30] Foreign Application Priority Data

Jul. 26, 1995 [JP] Japan ..... 7/190155

[51] Int. Cl.[7] ..... H05B 6/76

[52] U.S. Cl. ..... 219/722; 219/724; 219/739; 126/197; 292/95

[58] Field of Search ..... 219/722, 723, 219/724, 739, 756; 126/197, 192; 292/95, 116

[56] References Cited

U.S. PATENT DOCUMENTS 3,865,097 2/1975 Robinson ..... 219/724

FOREIGN PATENT DOCUMENTS 59-45414 3/1984 Japan .
61-60008 4/1986 Japan .
64-31913 2/1989 Japan .

*Primary Examiner*—Philip H. Leung
*Attorney, Agent, or Firm*—Rossi & Associates

[57] ABSTRACT

A microwave oven comprises a heating compartment 3, a door 4 having a door key 6 for closing the front opening of the heating compartment 3, a hook spacer 13 manipulated by the door 4, a door hook 9 to be engaged with the door key 6, and switches 10, 11, 12 turned on or off by the door key 6 and hook spacer 13, wherein the door key 6 is made of a resin filled with at least one of acicular crystals of potassium titanate, calcium metasilicate, magnesium pyroborate, barium titanate, and zinc oxide of which Mohs's hardness is lower than that of glass fiber, with the diameter of acicular crystal being 0.1 $\mu$m or more and 50 $\mu$m or less, and the door hook 9 to be engaged with the door key 6 is made of a resin material filled with glass fiber, with the resin surface roughness of the door key 6 being smaller than the resin surface roughness of the door hook 9, thereby not required to apply grease on the sliding parts of the door key 6 and door hook 9.

7 Claims, 5 Drawing Sheets

Relation between fiber diameter and tensile strength

SELF LUBRICATING DOOR KEY AND DOOR HOOK FOR HIGH FREQUENCY HEATING APPARATUS

TECHNICAL FIELD

The present invention relates to a high frequency heating apparatus having a door of a microwave oven or microwave oven-range provided with a switch function, so as to turn off the switch and stop oscillation of microwaves when the door is opened, and to turn on the switch and start oscillation of microwaves when the door is closed.

BACKGROUND ART

In the conventional microwave oven having a laterally opening door, the role of the switch for stopping oscillation of microwaves for cooking and heating is provided by combination of a door key formed in the door and the door hook formed in the main body, and the latch switch is cut off when the door is opened and the latch switch is turned on when the door is closed, and by turning on the operation switch of the main body, oscillation of microwaves is started. The door key and door hook are composed so as to be engaged with each other as the mutual contact surfaces slide to be engaged with each other, and the sliding surfaces were coated with grease to have lubricity, and the sliding surfaces were prevented from being abraded and worn out during use so that, finally, the latch switch may not fail to work.

For grease application on the sliding surfaces, however, uneven coating tends to occur, and the sliding becomes poor when coating is insufficient, and abrasion of the sliding surfaces may increase, and the microwave oven may fail to work if the door is closed. Besides, as the grease is applied on the sliding surfaces, it may be discolored due to contamination or deterioration in a long course of use, and the appearance becomes poor.

DISCLOSURE OF THE INVENTION

In the light of the above background, it is a primary object of the invention to present a high frequency heating apparatus characterized by specifying the material used in the door key or door hook, so as to be free from switch trouble due to abrasion of sliding parts in a long course of use without applying grease on the sliding parts of the door key and door hook. It is also an object of the invention to eliminate defective appearance due to contamination or deterioration of grease by not applying grease on the sliding parts.

To achieve the objects, according to first means of the invention, the door key is made of a resin filled with acicular crystal of which Mohs' hardnesses is lower than that of glass fiber, and the door hook to be engaged with the door key is made of a resin material filled with glass fiber.

According to second means of the invention, the door key is made of a resin filled with at least one of acicular crystals of potassium titanate, calcium metasilicate, magnesium pyroborate, barium titanate, and zinc oxide of which Mohs' hardness is lower than that of glass fiber, and the door hook to be engaged with the door key is made of a resin material filled with glass fiber.

According to third means of the invention, the door key is made of a resin filled with at least one of acicular crystals of potassium titanate, calcium metasilicate, magnesium pyroborate, barium titanate, and zinc oxide of which Mohs's hardness is lower than that of glass fiber, with the diameter of acicular crystal being 0.1 $\mu$m or more and 50 $\mu$m or less, and the door hook to be engaged with the door key is made of a resin material filled with glass fiber.

According to fourth means of the invention, the door key is made of a resin filled with acicular crystal of which Mohs' hardnesses is lower than that of glass fiber, and the door hook to be engaged with the door key is made of a resin material filled with glass fiber, with the resin surface roughness of the door key being smaller than the resin surface roughness of the door hook.

The invention, being thus constituted, can prevent malfunction due to abrasion by sliding of the door key and door hook by opening and closing of the door without applying grease on the sliding parts of the door key and door hook. It is also free from defective appearance due to contamination by application of grease on the sliding parts of the door key and door hook and discoloration of the grease as experienced in the prior art.

BEST MODE OF CARRYING OUT THE INVENTION

Referring now to FIG. 1 to FIG. 5, an embodiment of the invention is described in detail below.

Figure 1:
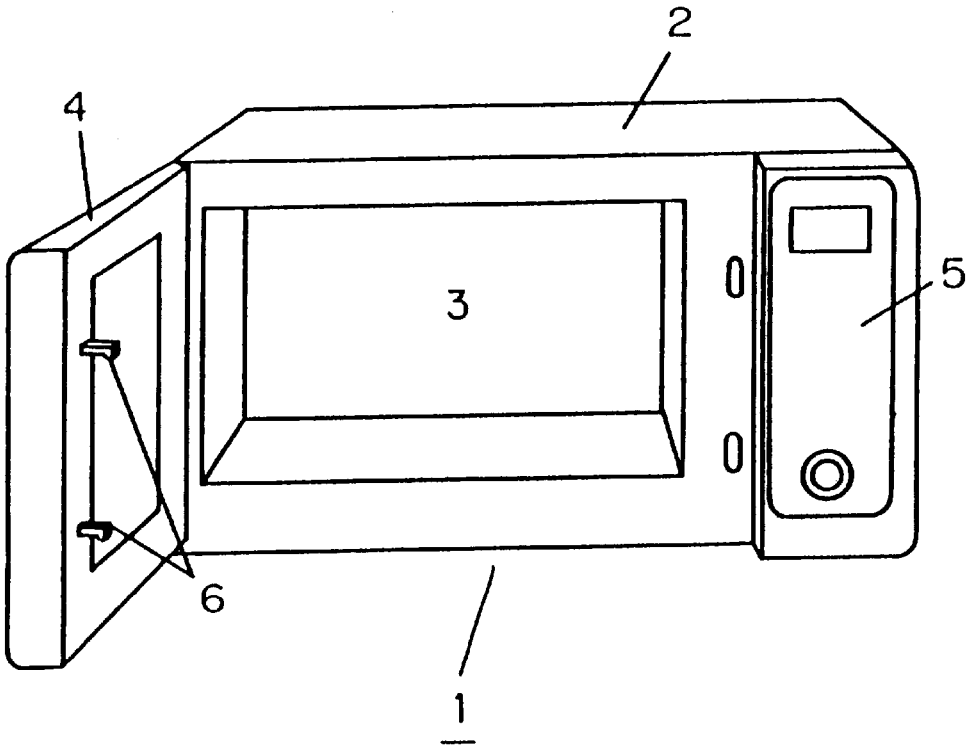
FIG. 1 is a perspective appearance view of open door state of a microwave oven in an embodiment of the invention.
Figure 2:
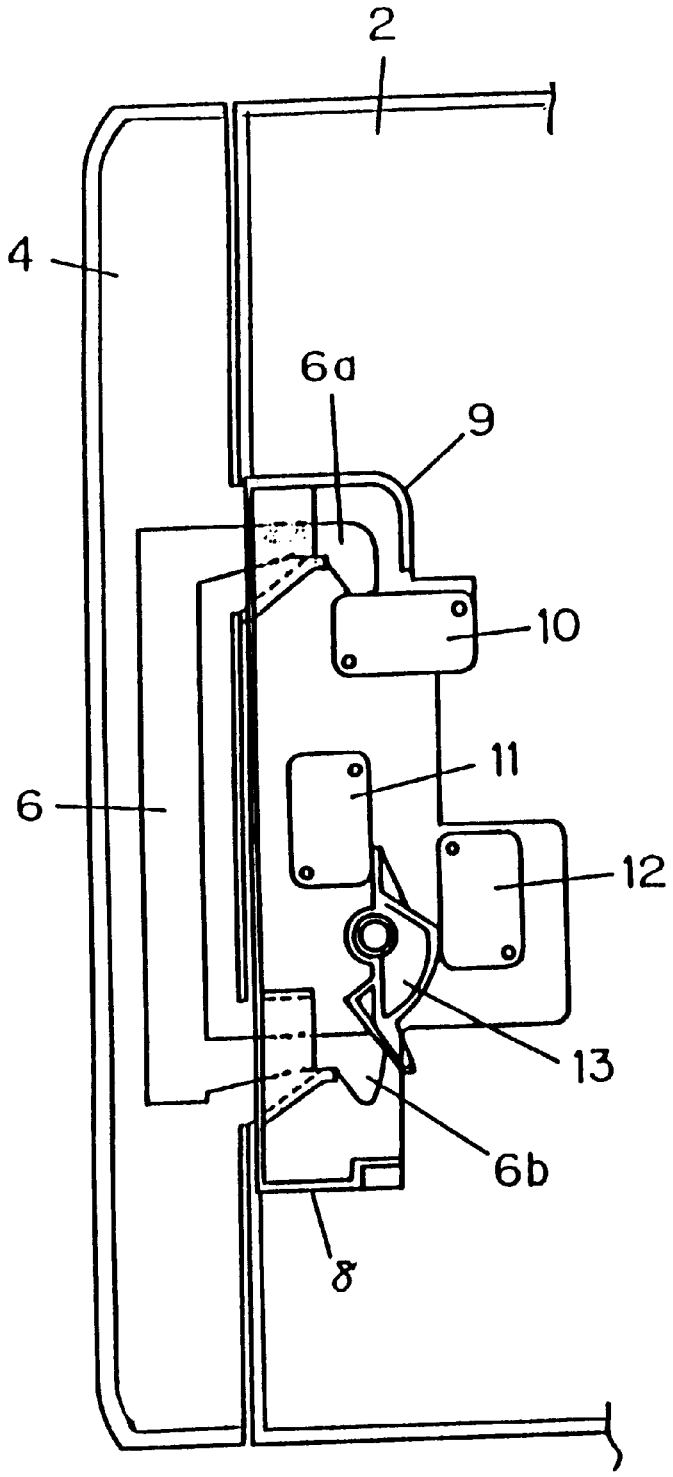
FIG. 2 is an essential sectional view showing door key and door hook of the microwave oven.

In FIG. 1 and FIG. 2, reference numeral 1 is a microwave oven which is a high frequency heating apparatus, and the microwave oven 1 consists of a microwave oven main body 2 (hereinafter called main body), a heating compartment 3 for accommodating the food, a door 4 for closing the heating compartment 3, and an operation unit 5, and the door 4 is provided with a door key 6, and in combination with a door hook 9, a latch switch A 10, a latch switch B 11, and a short switch 12 incorporated in the main body 2, a latch switch (switch) is composed for stopping oscillation of microwaves by a magnetron (not shown) for heating the food.

Figure 3:
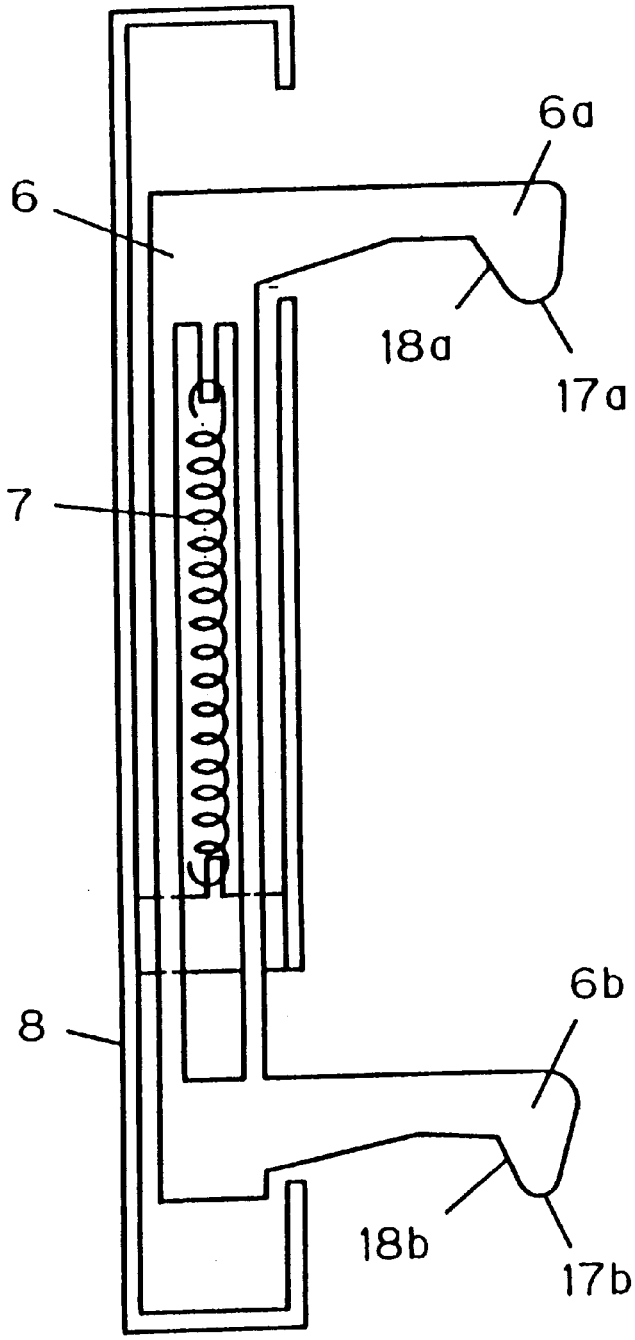
FIG. 3 is an essential sectional view showing the door key of the microwave oven.

The door key 6 is designed to slide as being coupled with a door key cover 8 and a spring 7 shown in FIG. 3, and the door hook 9 has the latch switch A 10, latch switch B, and short switch 12 for stopping oscillation of microwaves, and when the door 4 is closed, an upper key 6*a* of the upper side of the door key 6 pushes the latch switch A 10, and a lower key 6*b* at the lower side of the door key 6 pushes the latch switch B 11 and short switch 12 through a hook spacer 13, thereby turning on the latch switch A 10, latch switch B 11, and short switch 12, so that it is ready to start oscillation of microwaves. When the door 4 is opened, on the other hand, the door key 6 is detached from the door hook 9, and the latch switch A 10, latch switch B 11, and short switch 12 are turned off, so that oscillation of microwaves is stopped.

Figure 4:
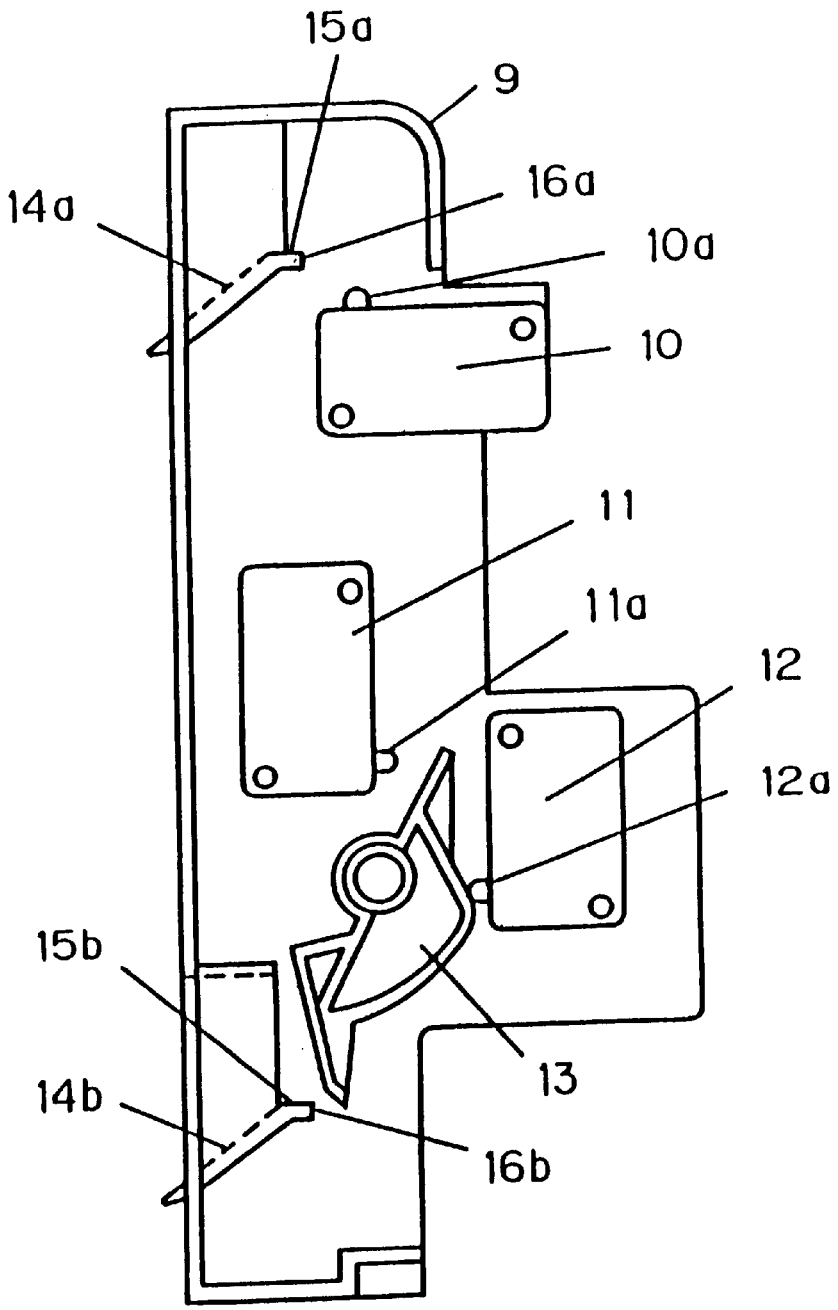
FIG. 4 is an essential sectional view showing the door hook of the microwave oven.

In this constitution, when the door 4 is closed, as shown in FIG. 3 and FIG. 4, an upper key leading end portion 17*a* of the upper key 6*a* of the door key 6 contacts with an upper key insertion portion 14*a* of the door hook 9, and slides upward to pass a flat portion 15*a* inside of the upper key insertion portion and further passes an end portion 16*a* inside of the upper key insertion portion and pushes the button 10*a* of the latch switch A 10 while causing the end portion 16*a* inside of the upper key insertion portion and the upper key leading end lower portion 18*a* to rub against each other, thereby turning on the latch switch A 10. Similarly, a lower key leading end portion 17*b* of the lower key 6*b* of the door key 6 contacts with a lower key insertion portion 14*b* of the door hook 9, and slides upward to pass a flat portion 15*b* inside of the lower key insertion portion, and further passes an end portion 16*b* inside of the lower key insertion portion and pushes the hook spacer 13 while causing the end portion 16*b* inside of the lower key insertion portion and the lover key leading end lower portion 18*b* to rub against each other, and thereby-the hook spacer 13 pushes the button 11*a* of the latch switch B 11 and button 12*a* of the short switch 12, thereby turning on the latch switch B11 and short switch 12. When opening the door 4, in reverse operation, the latch switch A 10, latch switch B 11, and short switch 12 are turned off.

In this embodiment, the door key 6 is formed of a resin adding 5 wt. % of potassium titanate whisker to PBT (polybutylene terephthalate). Conventionally, using the door key made of resin blending 10 wt. % of glass fiber to PBT resin, and the door hook made of resin blending 10 wt. % of glass fiber to PBT resin, as mentioned above, the lubricity was enhanced by applying grease on the sliding parts, but when the grease application was not enough, the door key and door hook rubber against each other, and the rubbing parts abraded, and the leading end of the key failed to push the button of the latch switch A provided in the door hook, as a result, microwaves were not oscillated, and the microwave oven failed to work. In the conventional glass fiber filled PBT, the skin layer of the PBT resin was peeled and internal glass fibers were exposed, and the exposed glass fibers acted like files to abrade mutually and were worn out.

In the invention, however, the glass fiber of the resin of the door key 6 is replaced by acicular crystal lower in hardness than the glass fiber to avoid the file effect to abrade the opposite door hook 9. Besides, the glass fiber is large in diameter, large in fiber diameter, and hence large in surface roughness to form a rough file surface to abrade the opposite surface, but by using the acicular crystal of smaller diameter and smaller fiber diameter, the surface roughness is smaller, and the degree of wear is smaller, so that the opposite door hook 9 may be hardly abraded. Whisker of potassium titanate has Mohs' hardness of 4 which is lower as compared with glass fiber, and the wear is less if rubbing against the glass fiber filled PBT. The thrust wear test data is shown in Table 1.

TABLE 1

| Sample | | Coefficient kinematic | Specific wear ($mm^3$/kgfkm) | |
|---|---|---|---|---|
| Fixed side | Rotating side | viscosity $\mu k$ | Fixed side | Rotating side |
| PBT/GF | PBT/GF | 0.44 | 0.0812 | 0.0920 |
| PBT/GF | PBT/TIK | 0.16 | 0 | 0.0450 |
| PBT/TIK | PBT/GF | 0.38 | 0.0640 | 0.0330 |
| PBT/TIK | PBT/TIK | 0.51 | 0.0394 | 0.0619 |

PBT/GF: glass fiber filled PBT
PBT/TIK: potassium titanate whisker filled PBT

As known from Table 1, by testing in the conditions of surface pressure of 0.6 kgf/$cm^2$, peripheral speed of 30 cm/sec, and running distance of 10 km, the smallest wear was achieved by using glass fiber filled PBT at the fixed side, and potassium titanate filled PBT at the rotating side.

Moreover, in comparison of the door key 6 of the microwave oven 1 made of PBT containing 10 wt. % of glass fiber and the door hook 9 made of PBT containing 10% of glass fiber, and the door key 6 made of PBT containing 5 wt. % of potassium titanate whisker and the door hook made of PBT containing 10 wt. % of glass fiber, the door opening and closing test was conducted 150,000 strokes without application of grease, and in the case of the door key 6 of the microwave oven 1 made of PBT containing 10 wt. % of glass fiber and the door hook 9 made of PBT containing 10% of glass fiber, the door key 6 and door hook 9 abraded, and the latch switch failed or nearly failed, whereas in the case of the door key 6 made of PBT containing 5 wt. % of potassium titanate whisker and the door hook 9 made of PBT containing 10 wt. % of glass fiber, there was almost no abrasion, and the latch switch worked normally.

Figure 5:
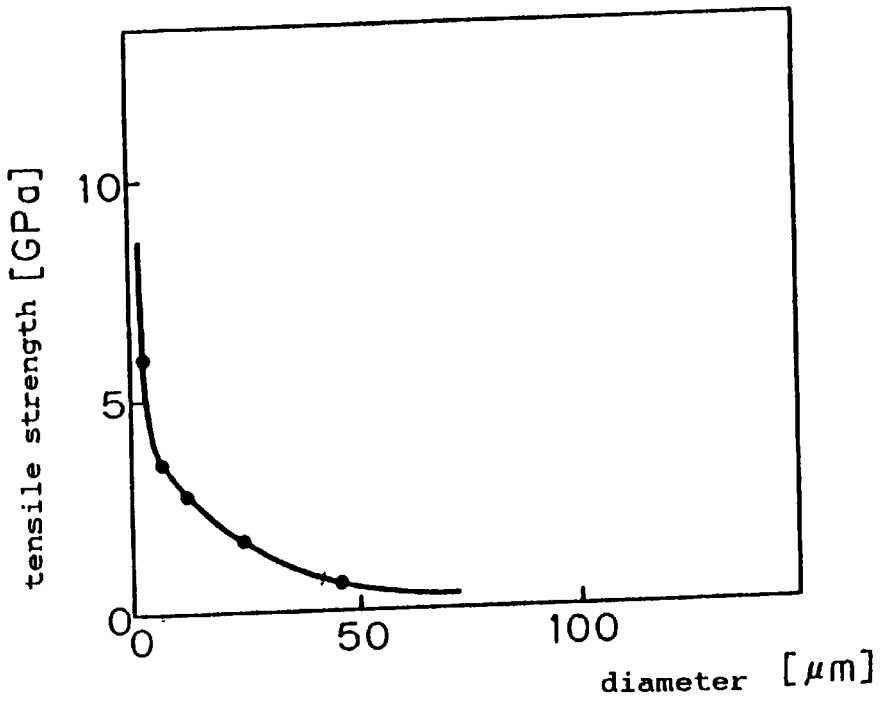
FIG. 5 is a diagram showing the relation between fiber diameter and tensile strength.

FIG. 5 shows the relation between fiber diameter and tensile strength. As known from the diagram, the tensile strength of fiber increased when the fiber diameter was 50 $\mu$m or less. Preferably, the tensile strength of fiber is higher at 0.1 $\mu$m or more and 5 $\mu$m or less. In the acicular crystal, the smaller the fiber diameter, the higher strength closer to the theoretical strength of the substance is realized, and it is known that the reinforcing effect is greater by using acicular crystal of smaller fiber diameter. In this embodiment, as the acicular crystal of whisker of potassium titanate, the material with mean fiber diameter of about 0.5 $\mu$m and mean fiber length of about 15 $\mu$m was used. Herein, the crystal with a short fiber is expressed as acicular crystal, but it also includes column and bar shape.

The reason of definition of diameter of acicular crystal of 0.1 $\mu$m or more is that the crystal length is not enough if the diameter of acicular single crystal is less than 0.1 $\mu$m, and therefore the reinforcing effect is smaller and the strength of the resin is lowered.

As the diameter of the acicular single crystal is larger, the crystal length becomes longer and the reinforcing effect increases and the resin strength is enhanced, but the surface roughness of the resin also increases and the lubricity drops. Therefore, the diameter of the acicular single crystal is preferred to be somewhere between 0.5 $\mu$m and 5 $\mu$m.

Besides, calcium metasilicate (wollastonite), magnesium pyroborate, barium titanate, and zinc oxide are also lower in Mohs' hardness than glass fiber, and are expected to enhance the lubricity, and also obtain reinforcing effects, so that the same effects as potassium titanate are obtained. As the acicular crystal of zinc oxide, whether in single fiber or in tetrapod, same effects are expected.

The embodiment relates to the microwave oven or microwave oven-range of laterally opening type, and in the case of microwave oven or microwave oven-range of vertically opening type, when the door key and door hook are engaged and the latch switch mechanism of friction structure is composed, by using the same resin material, abrasion is prevented, and hence it is equally effective.

INDUSTRIAL APPLICABILITY

According to the invention, as described herein, by using the door key made of a resin filled with acicular crystal of which Mohs' hardness is lower than that of glass fiber, malfunction of switch due to abrasion by sliding of the door key and door hook by opening and closing of the door can be prevented without applying grease on the sliding parts of the door key and door hook (or by applying very sparingly).

It hence presents the microwave oven free from defective appearance due to contamination by application of grease on the sliding parts of the door key and door hook and discoloration of greases.

What is claimed is:

1. A high frequency heating apparatus comprising:

a door;

a door key coupled to the door, wherein the door key comprises a resin filled with acicular crystal of which Mohs' hardness is lower than that of glass fiber; and a door hook that engages with the door key, wherein the door hook includes glass fiber.

2. A high frequency heating apparatus comprising:

a door;

a door key coupled to the door, wherein the door key comprises a resin filled with at least one of acicular crystals of potassium titanate, calcium metasilicate, magnesium pyroborate, barium titanate, and zinc oxide of which Mohs's hardness is lower than that of glass fiber; and a door hook that engages with the door key, wherein the door hook includes glass fiber.

3. A high frequency heating apparatus comprising:

a door;

a door key coupled to the door, wherein the door key comprises a resin filled with at least one of acicular crystals of potassium titanate, calcium metasilicate, magnesium pyroborate, barium titanate, and zinc oxide of which Mohs's hardness is lower than that of glass fiber, with the diameter of acicular crystal being 0.1 $\mu$m or more and 50 $\mu$m or less; and a door hook that engages with the door key, wherein the door hook includes glass fiber.

4. A high frequency heating apparatus comprising a heating compartment, a door having a door key for closing the front opening of the heating compartment, a hook spacer manipulated by the door, a door hook to be engaged with the door key, and a switch turned on or off by the door key and hook spacer, wherein the door key is made of a resin filled with acicular crystal of which Mohs' hardnesses is lower than that of glass fiber, and the door hook to be engaged with the door key is made of a resin material filled with glass fiber.

5. A high frequency heating apparatus comprising a heating compartment, a door having a door key for closing the front opening of the heating compartment, a hook spacer manipulated by the door, a door hook to be engaged with the door key, and a switch turned on or off by the door key and hook spacer, wherein the door key is made of a resin filled with at least one of acicular crystals of potassium titanate, calcium metasilicate, magnesium pyroborate, barium titanate, and zinc oxide of which Mohs's hardness is lower than that of glass fiber, and the door hook to be engaged with the door key is made of a resin material filled with glass fiber.

6. A high frequency heating apparatus comprising a heating compartment, a door having a door key for closing the front opening of the heating compartment, a hook spacer manipulated by the door, a door hook to be engaged with the door key, and a switch turned on or off by the door key and hook spacer, wherein the door key is made of a resin filled with at least one of acicular crystals of potassium titanate, calcium metasilicate, magnesium pyroborate, barium titanate, and zinc oxide of which Mohs's hardness is lower than that of glass fiber, with the diameter of acicular crystal being 0.1 $\mu$m or more and 50 $\mu$m or less, and the door hook to be engaged with the door key is made of a resin material filled with glass fiber.

7. A high frequency heating apparatus comprising a heating compartment, a door having a door key for closing the front opening of the heating compartment, a hook spacer manipulated by the door, a door hook to be engaged with the door key, and a switch turned on or off by the door key and hook spacer, wherein the door key is made of a resin filled with at least one of acicular crystals of potassium titanate, calcium metasilicate, magnesium pyroborate, barium titanate, and zinc oxide of which Mohs's hardness is lower than that of glass fiber, with the diameter of acicular crystal being 0.1 $\mu$m or more and 50 $\mu$m or less, and the door hook to be engaged with the door key is made of a resin material filled with glass fiber, with the resin surface roughness of the door key being smaller than the resin surface roughness of the door hook.

* * * * *